United States Patent [19]

Katoh et al.

[11] Patent Number: 4,908,293

[45] Date of Patent: Mar. 13, 1990

[54] SUPERHIGH CONTRAST NEGATIVE TYPE SILVER HALIDE PHOTOGRAPHIC MATERIAL

[75] Inventors: Kazunobu Katoh; Yoshihiro Takagi; Kimitaka Kameoka; Junji Miyata; Toshinao Ukai, all of Kanagawa, Japan

[73] Assignee: Fuji Photo Film Co., Ltd., Kanagawa, Japan

[21] Appl. No.: 93,341

[22] Filed: Sep. 4, 1987

[30] Foreign Application Priority Data

Sep. 5, 1986 [JP] Japan ..... 61-209169

[51] Int. Cl.[4] ..... G03C 1/36

[52] U.S. Cl. ..... 430/264; 430/606

[58] Field of Search ..... 430/606, 264

[56] References Cited

U.S. PATENT DOCUMENTS 3,910,795 10/1975 Shiba et al. ..... 430/597

4,681,836 7/1987 Inoue et al. ..... 430/264

*Primary Examiner*—Richard L. Schilling

*Attorney, Agent, or Firm*—Sughrue, Mion, Zinn, Macpeak & Seas

[57] ABSTRACT

A superhigh contrast negative type silver halide photographic material, comprising a support having provided thereon at least one silver halide emulsion layer, wherein the emulsion layer or at least one other hydrophilic colloid layer contains at least one hydrazine derivative and at least one organic desensitizer having at least one water-soluble group or alkali-dissociative group. The material has a reduced sensitivity suitable for processing in a bright room while enjoying the effect of the hydrazine derivative to increase contrast.

7 Claims, No Drawings

SUPERHIGH CONTRAST NEGATIVE TYPE SILVER HALIDE PHOTOGRAPHIC MATERIAL

FIELD OF THE INVENTION

This invention relates to a silver halide photographic material and a method for forming a super-high contrast negative image using the same. More particularly, it relates to a silver halide photographic material for use in photomechanical process, inter alia, a superhigh contrast negative type photographic material suitable for processing in a bright room.

BACKGROUND OF THE INVENTION

In the field of the graphic arts, achievement or satisfactory reproduction of a continuous tone image with dots or a line image requires an image formation system capable of producing a developed image exhibiting superhigh contrast characteristics. A photographic system having a gamma of not less than 10 is particularly desired.

For this purpose, a special developer. called a lith developer has been conventionally employed. A lith developer contains hydroquinone as a sole developing agent and, as a preservative, a sulfite in the form of an adduct with formaldehyde so as to have the free sulfite ion concentration controlled at an extremely low level, usually not more than 0.1 mol/liter, in order not to inhibit infectious development. Therefore, the lith developer is extremely susceptible to air oxidation and does not withstand preservation for more than 3 days.

Use of hydrazine derivatives has been proposed for obtaining a high contrast image with a stable developing solution as disclosed in U.S. Pat. Nos. 4,224,401, 4,168,977, 4,166,742, 4,311,781, 4,272,606, 4,211,857, 4,243,739, etc. According to this technique, photographic characteristics of superhigh contrast and high sensitivity can be assured, and the stability of the developer to air oxidation is markedly improved over lith developers since addition of a sulfite to the developer at a high concentration is permissible.

However, although the above-described image formation system is suitable for obtaining high contrast photographic images employing photographic materials having very high sensitivity, this high sensitivity makes it difficult to adopt these systems for development in a bright room. Development in a bright room is normally carried out with photographic materials of low sensitivity which, for reasons discussed below, do not give high contrast images.

With respect to light-sensitive materials having low sensitivity sufficient for development in a bright room, Japanese Patent Application (OPI) Nos. 83038/85 and 162246/85 (the term "OPI" as used herein refers to a "published unexamined Japanese patent application") disclose a contrast system using a hydrazine derivative in which a silver halide light-sensitive material contains a water-soluble rhodium salt. However, addition of a rhodium salt in an amount enough to lower sensitivity results in hindrance of the effect of the hydrazine derivative to increase contrast, thus failing to obtain an image of a desired contrast. Further, it is disclosed in Japanese Patent Application (OPI) No. 62245/81 that a high contrast image can be obtained by developing in the presence of a tetrazolium compound to thereby inhibit development in the toe portion of a characteristic curve. This technique, however, involves problems such that the silver halide light-sensitive material containing the tetrazolium compound is easily deteriorated during preservation and is then capable only of providing a low contrast image, and further that a reaction product of the tetrazolium compound formed upon development partly remains in the film, which causes stains and uneven development.

On the other hand, Japanese Patent Application (OPI) No. 157633/84 proposes a process for producing a silver halide photographic emulsion containing a water-soluble rhodium salt in an amount of from $10^{-8}$ to $10^{-5}$ mol per mol of silver halide and an organic desensitizer whose polarogram shows that the sum of the anode potential and the cathode potential is positive. This process succeeds in reducing sensitivity but fails to provide an image having a high contrast sufficient for use in the field to which the present invention is directed. Besides, there is found no suggestion about use of a hyrazine compound in the above-cited patent application.

Use of an organic desensitizer in high contrast silver halide light-sensitive materials containing a hydrazine compound has conventionally encountered great technical difficulty in application, probably for the following reasons. A hydrazine compound is a motive force for bringing a high contrast, taking part in development processing and inducing nucleation infectious development due to its electron donating property. On the other hand, an organic desensitizer is a photoelectron acceptor which accepts a photoelectron upon imagewise exposure to light to hinder formation of a latent image, resulting in reduction of sensitivity. At the same time, since the organic desensitizer also accepts an electron donated by an electron donor, such as a hydrazine compound, during development processing, the nucleation infectious development is inhibited, resulting in the failure of obtaining a high contrast image.

SUMMARY OF THE INVENTION

As a result of extensive investigations, the inventors have overcome the above-described problems and realized a photographic material suitable for development in a bright room while utilizing hydrazine compounds imparting high contrast.

That is, the present invention relates to a superhigh contrast negative type silver halide photographic material comprising a support having provided thereon at least one silver halide emulsion layer, wherein the emulsion layer or other hydrophilic colloid layer contains at least one hydrazine derivative capable of imparting high contrast to a developed image and at least one organic desensitizer having at least one water-soluble group or alkali-dissociative group.

DETAILED DESCRIPTION OF THE INVENTION

Hydrazine derivatives which can preferably be used in the present invention include hydrazine derivatives having the following structure as described in U.S. Pat. No. 4,478,928:

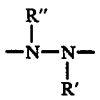

wherein R′ can be either hydrogen or a sulfinic acid radical substituent, and R″ is chosen to be a sulfinic acid radical substituent when R′ is hydrogen and hydrogen when R′ is a sulfinic acid radical; and compounds represented by formula (I):

$$R_1—NHNH—CHO \quad (I)$$

wherein $R_1$ represents an aliphatic group or an aromatic group.

In formula (I), the aliphatic group as represented by $R_1$ is preferably a substituted or unsubstituted straight or branched chain or cyclic alkyl group having from 1 to 30 carbon atoms, and more preferably from 1 to 20 carbon atoms. The branched alkyl group may be cyclized to form a saturated hetero ring containing at least one atom which is not carbon. The substituents for the alkyl group include an aryl group, an alkoxy group, a sulfoxy group, a sulfonamido group, a carbonamido group, etc.

Specific examples of the aliphatic group for $R_1$ include a t-butyl group, an n-octyl group, a t-octyl group, a cyclohexyl group, a pyrrolidyl group, an imidazolyl group, a tetrahydrofuryl group, a morpholino group, etc.

The aromatic group as represented by $R_1$ is a substituted or unsubstituted monocyclic or bicyclic aryl group or a substituted or unsubstituted unsaturated heterocyclic group. The unsaturated heterocyclic group may be condensed with a monocyclic or bicyclic aryl group to form a heteroaryl group.

Specific examples of the aromatic group include a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, etc. Of these, those containing a benzene ring are preferred.

The aromatic group may have one or more substituents. Typical substituents for the aromatic group include a straight or branched chain or cyclic alkyl group (preferably having from 1 to 20 carbon atoms), an aralkyl group (preferably comprising a monocyclic or bicyclic aryl moiety and an alkyl moiety having from 1 to 3 carbon atoms), an alkoxy group (preferably having from 1 to 20 carbon atoms), a substituted amino group (preferably substituted by an alkyl group having from 1 to 20 carbon atoms), an acylamino group (preferably having from 2 to 30 carbon atoms), a sulfonamido group (preferably having from 1 to 30 carbon atoms), a ureido group (preferably having from 1 to 30 carbon atoms), and the like.

In particular, $R_1$ preferably represents a monocyclic or bicyclic aryl group.

The aliphatic or aromatic group as represented by $R_1$ may have incorporated therein a ballast group commonly employed in nondiffusible photographic additives, such as couplers. The ballast group is selected from those groups that contain 8 or more carbon atoms and are relatively inert to photographic characteristics, such as an alkyl group, an alkoxy group, a phenyl group, an alkylphenyl group, a phenoxy group, an alkylphenoxy group, and the like.

The aliphatic or aromatic group as represented by $R_1$ may further have incorporated therein a group enhancing adsorption onto silver halide grains. Such an adsorptive group includes a thiourea group, a heterocyclic thioamido group, a mercapto heterocyclic group, a triazole group, etc., as described in U.S. Pat. No. 4,385,108.

Methods of synthesizing the compounds of formula (I) are described, e.g., in Japanese Patent Application (OPI) Nos. 20921/78, 20922/78, 66732/78, and 20318/78.

The hydrazine derivative of formula (I) according to the present invention is preferably incorporated in a silver halide emulsion layer, but may be incorporated in any other light-insensitive hydrophilic colloid layer, such as a protective layer, an intermediate layer, a filter layer, an antihalation layer, and the like. Incorporation of the compound (I) can be carried out by dissolving it in water in the case of using a water-soluble compound or in a water-miscible organic solvent, e.g., alcohols, esters, ketones, etc., in the case of using a sparingly water-soluble compound, and adding the solution to a hydrophilic colloid solution. When it is added to a silver halide emulsion layer, addition may be effected at any stage of from the commencement of chemical ripening up to the stage immediately before coating, and preferably from the end of chemical ripening to the stage before coating. In particular, the compound is preferably added to a coating composition ready to be coated.

The amount of the compound of formula (I) to be added is desirably selected so as to obtain best results according to the grain size and halogen composition of silver halides, the method and degree of chemical sensitization, the relation between the layer to which the compound is added and a silver halide emulsion layer, the kind of antifoggant used, and the like. Such selection can be made easily by one skilled in the art. Usually, the compound of formula (I) is preferably used in an amount of from $10^{-6}$ to $1\times10^{-1}$ mol and more preferably from $10^{-5}$ to $4\times10^{-2}$ mol, per mol of total silver halide.

Specific but non-limiting examples of the compounds represented by formula (I) are shown below.

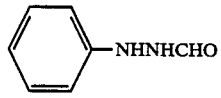

(I-1)

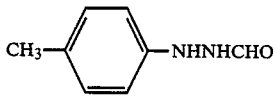

(I-2)

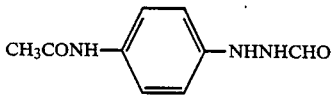

(I-3)

-continued
(I-4)
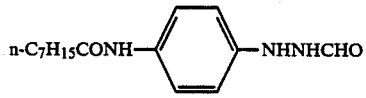
(I-5)
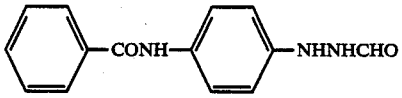
(I-6)
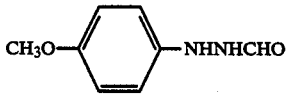
(I-7)
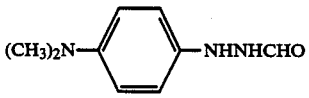
(I-8)
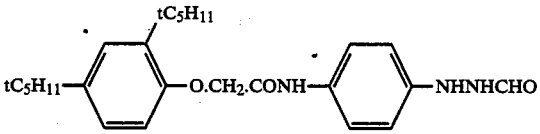
(I-9)
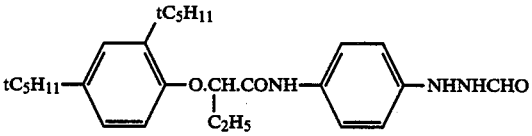
(I-10)
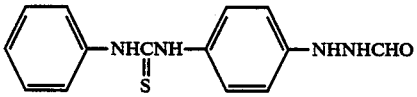
(I-11)
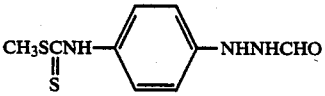
(I-12)
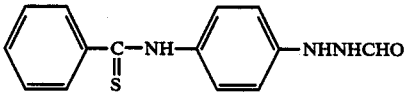
(I-13)
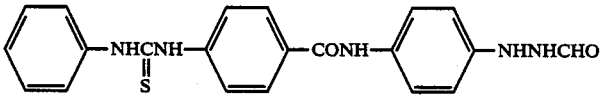
(I-14)
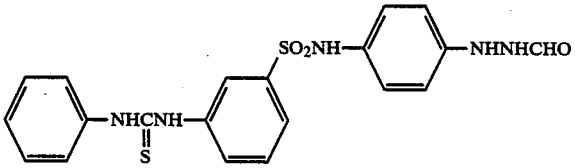
(I-15)
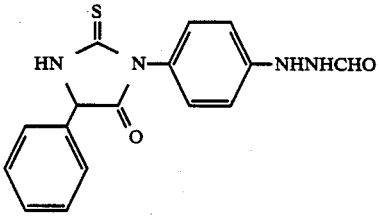

-continued
(I-16)
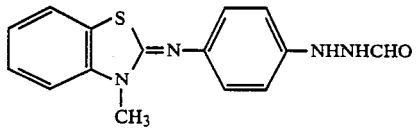
(I-17)
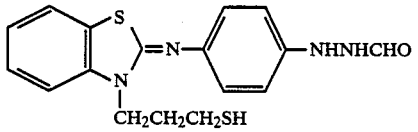
(I-18)
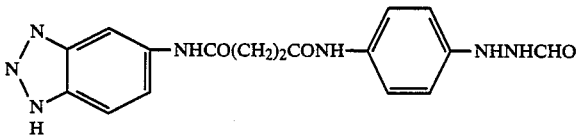
(I-19)
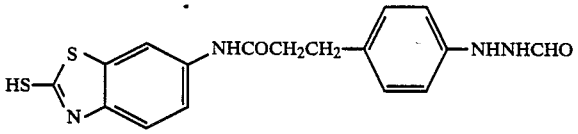
(I-20)
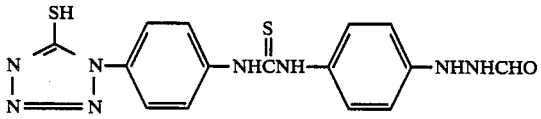
(I-21)
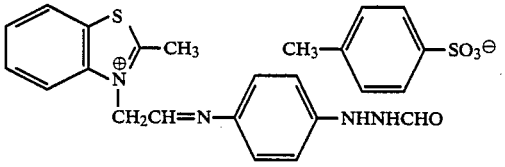
(I-22)
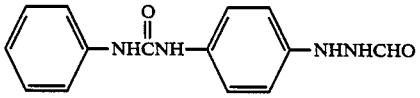
(I-23)
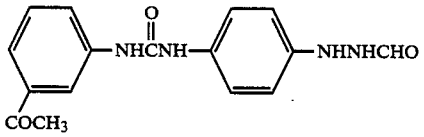
(I-24)
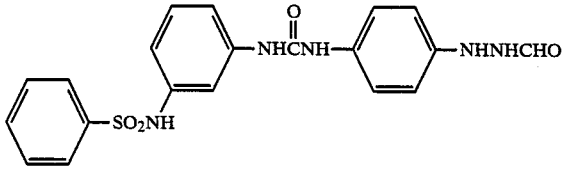
(I-25)
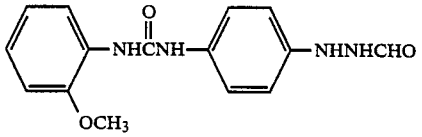

-continued (I-26)

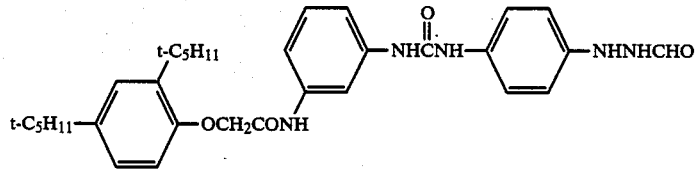

(I-27)

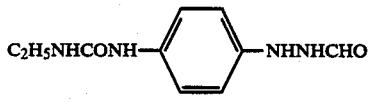

(I-28)

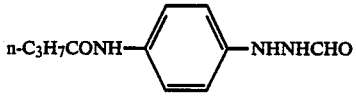

(I-29)

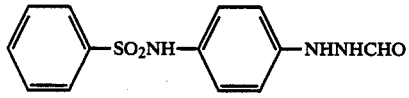

(I-30)

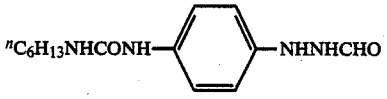

(I-31)

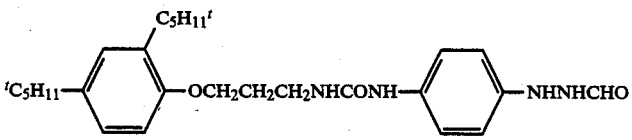

(I-32)

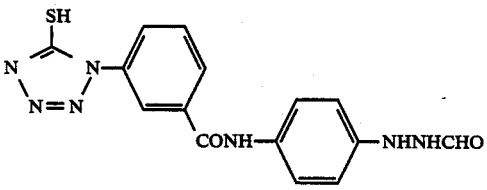

(I-33)

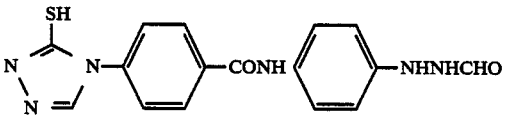

In addition, compounds disclosed in U.S. Pat. No. 4,478,928, such as those shown below, may also be used.

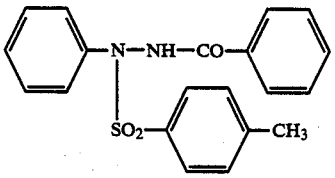

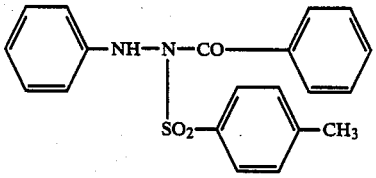

-continued

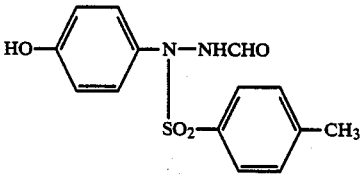

Silver halide emulsions which can be used in the present invention may have any halogen composition, including silver chloride, silver chlorobromide, silver iodobromide, silver iodochlorobromide, etc. Silver halide grains containing 60 mol% or more, and particularly 75 mol% or more, of silver chloride are preferred. More preferred is silver chlorobromide or silver chloroiodobromide containing not more than 5 mol% of silver bromide.

The silver halide grains to be used preferably have a small mean diameter (e.g., not more than 0.7 μm), and more preferably a diameter of not more than 0.5 μm. A grain size distribution is not essentially critical, but monodispersed emulsions having narrow size distribution are preferred. The terminology "monodispersed" as used herein means that at least 95% of the total weight or number of silver halide grains is included in the size range within ±40% of the mean grain size.

The silver halide grains may have a regular crystal form, such as cubic, octahedral, etc., an irregular crystal form, e.g., spherical, plate-like, etc., or may have a composite crystal form.

The silver halide grains may have a homogeneous phase throughout the individual grains or a heterogeneous phase having, e.g., a core-shell structure. Two or more silver halide emulsions separately prepared may be used as a mixture.

In the course of grain formation or physical ripening, a cadmium salt, a sulfite, a lead salt, a thallium salt, a rhodium salt or a complex salt thereof, an iridium salt or a complex salt thereof, etc., may be present in the system.

Among these, the rhodium salt or complex thereof can preferably used in the present invention since it is effective to reduce sensitivity and increase contrast.

The rhodium salt or complex thereof to be used includes rhodium monochloride, rhodium dichloride, rhodium trichloride, ammonium hexachlororhodate, etc. Preferred of these are water-soluble rhodium halogenorhodium (III) complex compounds, e.g., hexachlororhodium (III) acid or salts thereof (e.g., an ammonium salt, a sodium salt, and a potassium salt).

The amount of these water-soluble rhodium salts to be added ranges from $1.0\times10^{-8}$ mol to $1.0\times10^{-4}$ mol, and preferably from $1.0\times10^{-7}$ mol to $6.0\times10^{-5}$ mol, per mol of silver halide.

The organic desensitizer which can be used in the present invention is characterized by containing at least one water-soluble group or alkali-dissociative group. It has now been found that use of such an organic desensitizer in a high contrast light-sensitive material containing a hydrazine compound effectively reduces sensitivity without hindering the contrast enhancing effect of the hydrazine compound. While the phenomenon taking place in this system is extremely complicated, and its mechanism has not yet been elucidated, the following assumption could be made. The organic desensitizer accepts a photoelectron upon imagewise exposure to inhibit latent image formation to thereby lower sensitivity as mentioned above. However, the organic desensitizer according to the present invention is dissolved in a processing solution or isolated from silver halide grains during development processing so that it does not work as an acceptor for the electron donated by the hydrazine compound. As a result, it is believed that the hydrazine compound is allowed to function unimpededly to increase contrast.

The organic desensitizer to be used in the present invention is specified by its polarographic half wave potential, i.e., an oxidation reduction potential determined by polarography, in that the sum of the anode potential and the cathode potential is positive. The method of determining an oxidation reduction potential of a polarogram is described, e.g., in U.S. Pat. No. 3,501,307.

The water-soluble group present in the organic desensitizer includes a sulfo group, a carboxyl group, a phospho group, etc. These water-soluble groups may be in the form of a salt with an organic base, e.g., ammonia, pyridine, triethylamine, piperidine, morpholine, etc., or an alkali metal, e.g., sodium, potassium, etc.

The alkali-dissociative group present in the organic desensitizer is a substituent which undergoes deprotonation reaction at a pH of a developing solution (usually in the range of from 9 to 13) or a lower pH to become anionic. Such a group includes a substituent containing a nitrogen atom to which at least one hydrogen atom is bonded, e.g., a substituted or unsubstituted sulfamoyl group, a substituted or unsubstituted carbamoyl group, a sulfonamido group, an acylamino group, a substituted or unsubstituted ureido group, etc.; a hydroxyl group; and, in addition, a nitrogen-containing hetero-cyclic group having a hydrogen atom on the nitrogen atom which is a constituent of the hetero ring.

The aforesaid water-soluble group and alkali-dissociative group may be linked to any moiety of the organic desensitizer. The organic desensitizer may have two or more kinds of these groups.

Among the above-described organic desensitizers, preferred are those represented by the following formulae (II) to (IV).

Formula (II) is represented by

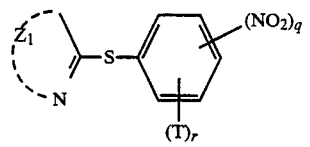

(II)

wherein $Z_1$ represents a non-metal atomic group necessary for forming a substituted or unsubstituted nitrogen-containing heterocyclic group; T represents a substituted or unsubstituted alkyl group, a substituted or unsubstituted cycloalkyl group, a substituted or unsubstituted alkenyl group, a halogen atom, a cyano group, a trifluoromethyl group, a substituted or unsubstituted alkoxy group, a substituted or unsubstituted aryloxy group, a hydroxyl group, a substituted or unsubstituted alkoxycarbonyl group, a carboxyl group, a substituted or unsubstituted carbamoyl group, a substituted or unsubstituted sulfamoyl group, a substituted or unsubstituted aryl group, a substituted or unsubstituted acylamino group, a substituted or unsubstituted sulfonamido group, a sulfo group or a substituted or unsubstituted benzene condensed ring; q represents 1, 2 or 3; and r represents 0, 1 or 2.

In formula (II), the nitrogen-containing heterocyclic ring completed by $Z_1$ includes a 1,2,4-triazole ring, a 1,3,4-oxadiazole ring, a 1,3,4-thiadiazole ring, a tetraazaindene ring, a pentaazaindene ring, a triazaindene ring, a benzothiazole ring, a benzimidazole ring, a benzoxazole ring, a pyrimidine ring, a triazine ring, a pyridine ring, a quinoline ring, a quinazoline ring, a phthalazine ring, a quinoxaline ring, an imidazo[4,5-b]quinoxaline ring, a tetrazole ring, a 1,3-diazazulene ring, etc., and substituted rings and condensed rings thereof.

Specific examples of the substituent for the substituted nitrogen-containing heterocyclic group of $Z_1$ in formula (II) include those as exemplified for the aromatic group of $R_1$ in formula (I). Furthermore, specific examples of the substituent are a nitro group, a halogen atom, a hydroxy group, a cyano group, a trifluoromethyl group, an alkoxycarbonyl group (preferably having 2 to 20 carbon atoms), a carboxyl group, an aryl group (preferably having 6 to 12 carbon atoms), a nitrogen-containing heterocyclic ring group, a benzene condensed ring, and a naphthalene condensed ring.

Formula (III) is represented by

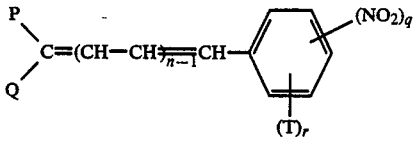

(III)

wherein P and Q, which may be the same or different, each represents a cyano group, an acyl group, a thioacyl group, an alkoxycarbonyl group, an alkylsulfonyl group, an arylsulfonyl group, a substituted or unsubstituted sulfamoyl group, a substituted or unsubstituted carbamoyl group, a nitro group or a substituted or unsubstituted aryl group; n represents 1, 2 or 3; and T, r, and q are as defined above.

Substituents for the sulfamoyl group and carbamoyl group which may be substituted include a straight or branched chain or cyclic alkyl group (preferably having 1 to 20 carbon atoms), an aryl group (preferably having 6 to 12 carbon atoms), and a nitrogen-containing heterocyclic ring group. Substituents for the aryl group which may be substituted include those as mentioned for $Z_1$ of formula (II).

Formula (IV) is represented by

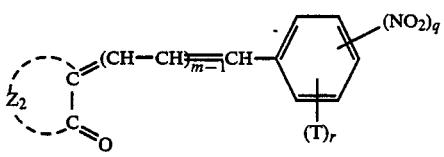

(IV)

wherein $Z_2$ represents a non-metal atomic group necessary for forming a ketomethylene ring (e.g., a pyrazolone ring, an isoxazolone ring, an oxyindole ring, a barbituric acid ring, a thiobarbituric acid ring, a rhodanine ring, an imidazo[1,2-a]pyridone ring, a 2-thio-2,4-oxazolidinedione ring, a 2-thio-2,5-thiazolidinedione ring, a thiazolidone ring, a 4-thiazolone ring, a 2-imino-2,4-oxazolinone ring, a 2,4-imidazolinedione ring (hydantoin ring), a 2-thiohydantoin ring, a 5-imidazolone ring, etc.); m represents 1, 2 or 3; and T, r, and q are as defined above.

Specific examples of the substituent for T of formulae (II), (III) and (IV) are those as exemplified for the substituents of $Z_1$.

In formulae (II) to (IV), at least one of $Z_1$ and T of formula (II), at least one of T, P and Q of formula (III), and at least one of $Z_2$ and T of formula (IV) have at least one water-soluble group or alkali-dissociative group, respectively.

Specific examples of the water-soluble group and alkali-dissociative group are mentioned above.

Specific but non-limiting examples of the compounds represented by formulae (II) to (IV) are shown below.

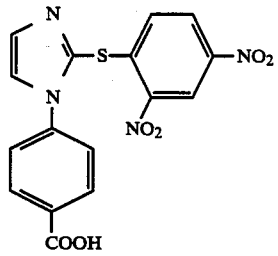

(II-1)

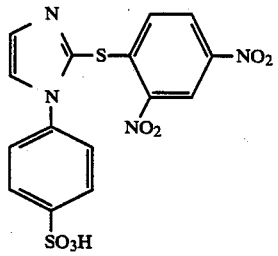

(II-2)

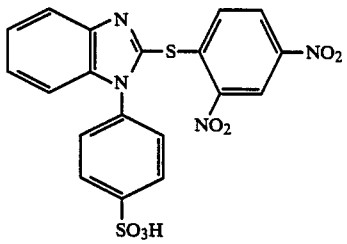

(II-3)

-continued
(II-4)
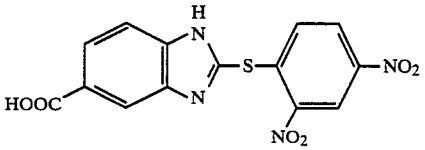
(II-5)
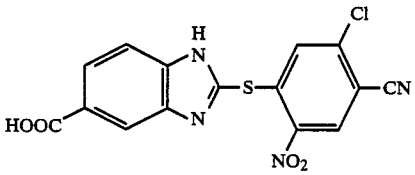
(II-6)
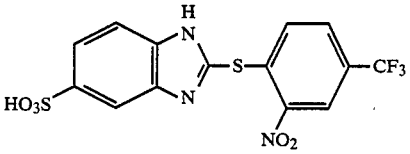
(II-7)
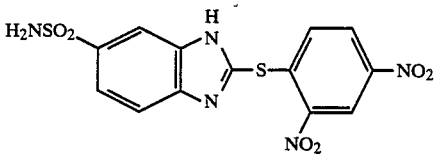
(II-8)
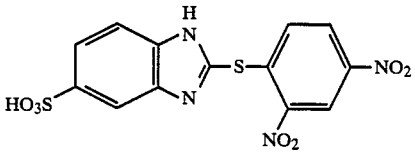
(II-9)
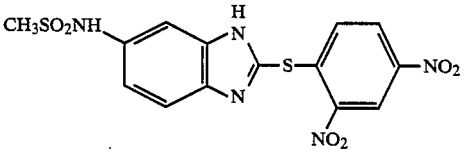
(II-10)
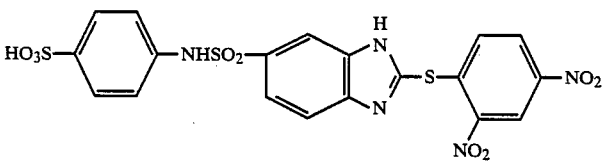
(II-11)
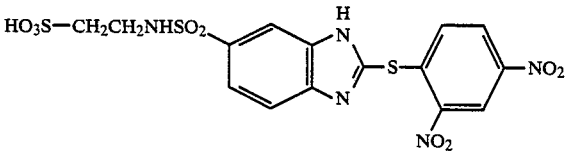
(II-12)
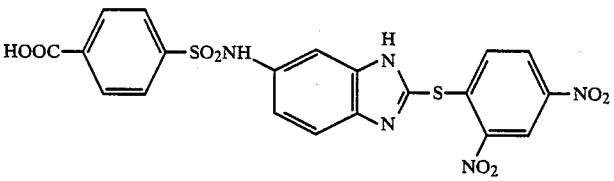

-continued
(II-13)
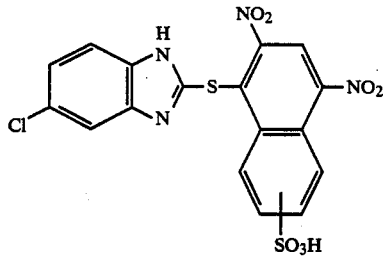
(II-14)
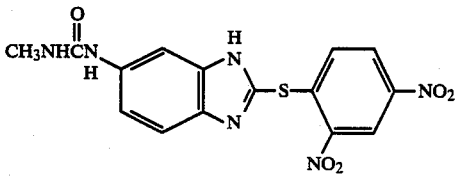
(II-15)
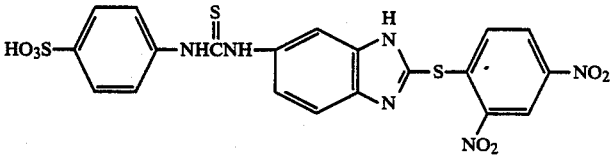
(II-16)
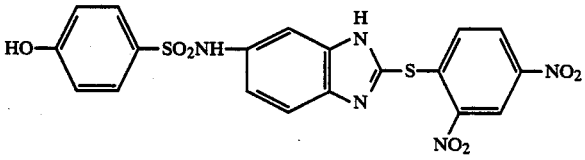
(II-17)
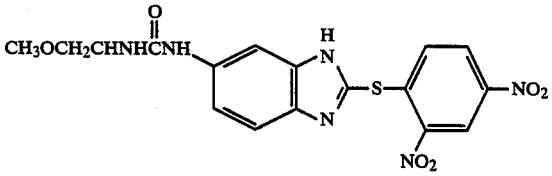
(II-18)
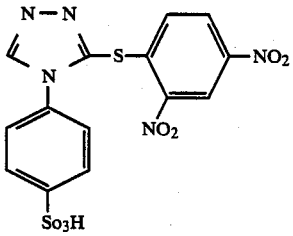
(II-19)
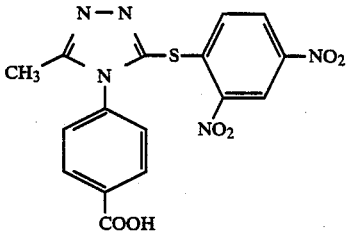

-continued
(II-20)
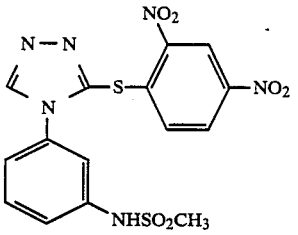
(II-21)
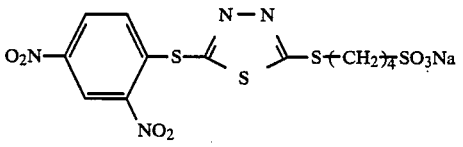
(II-22)
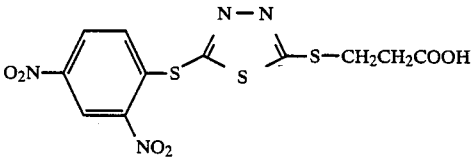
(II-23)
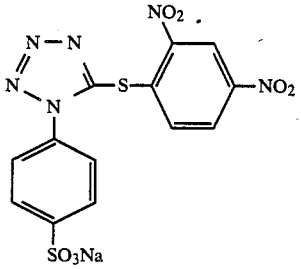
(II-24)
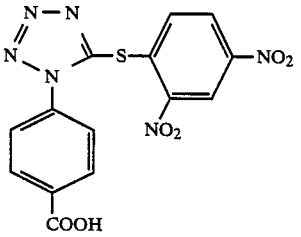
(II-25)
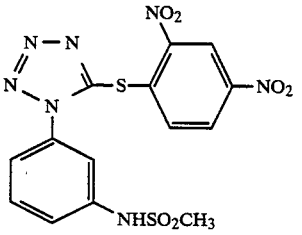
(II-26)
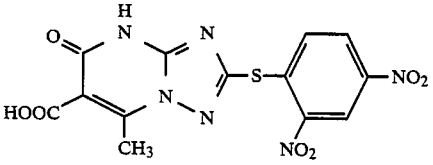
(II-27)
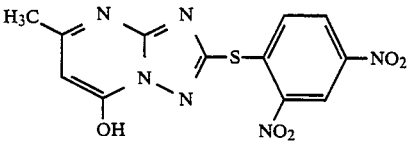

-continued
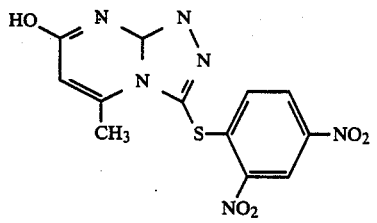
(II-28)
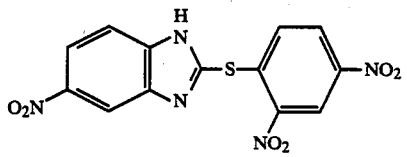
(II-29)
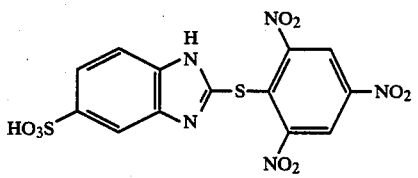
(II-30)
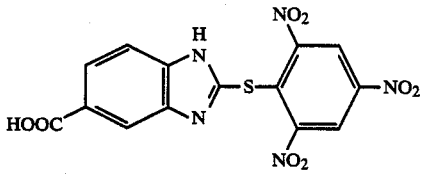
(II-31)
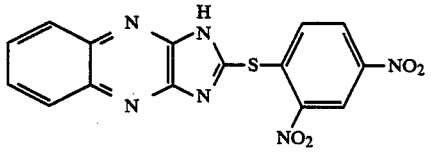
(II-32)
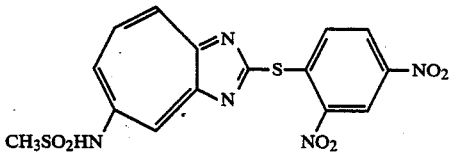
(II-33)
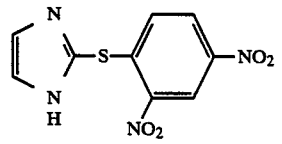
(II-34)
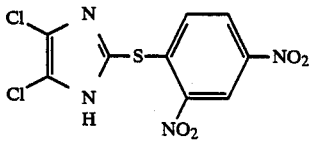
(II-35)
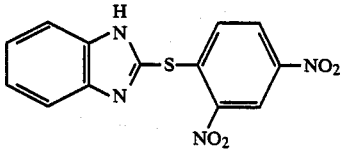
(II-36)

-continued
(II-37)
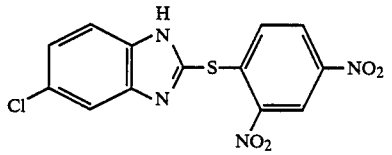
(II-38)
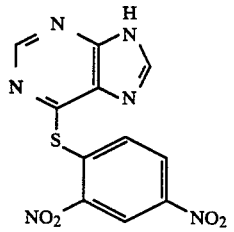
(II-39)
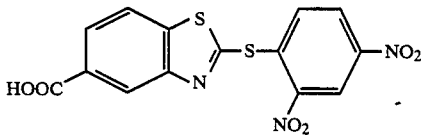
(II-40)
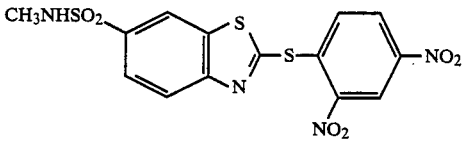
(II-41)
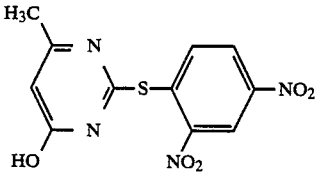
(III-1)
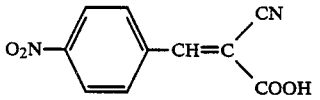
(III-2)
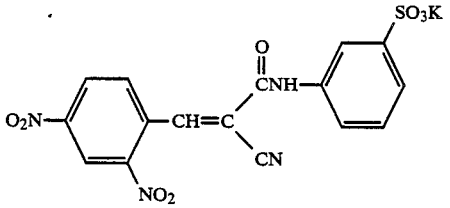
(III-3)
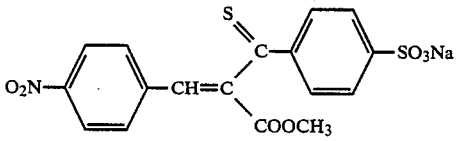
(III-4)
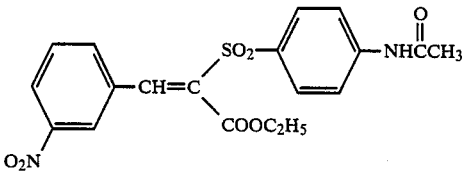

-continued
(III-5)
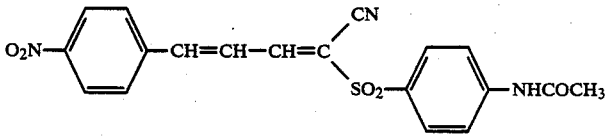
(III-6)
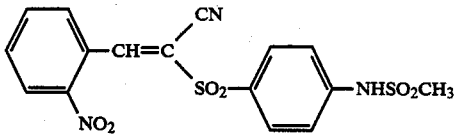
(IV-1)
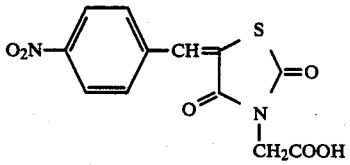
(IV-2)
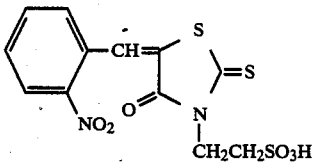
(IV-3)
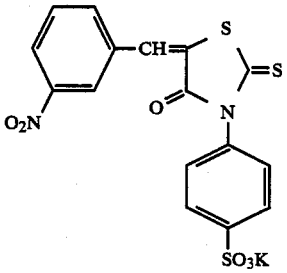
(IV-4)
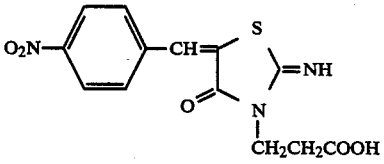
(IV-5)
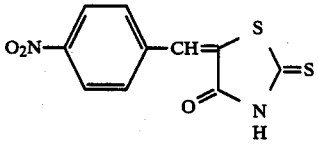
(IV-6)
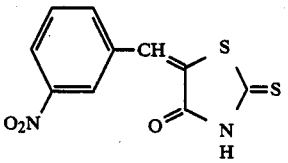
(IV-7)
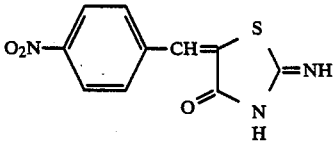

-continued

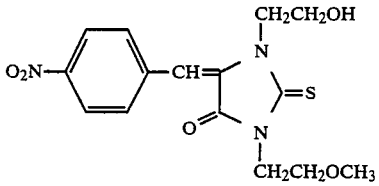
(IV-8)

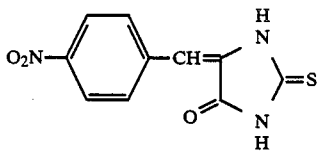
(IV-9)

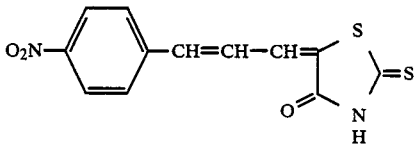
(IV-10)

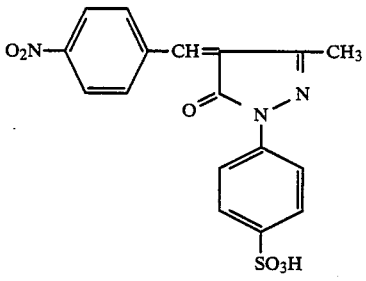
(IV-11)

The organic desensitizer is preferably present in a silver halide emulsion layer in an amount of from $1.0\times10^{-8}$ to $1.0\times10^{-4}$ mol/m$^2$, and more preferably from $1.0\times10^{-7}$ to $1.0\times10^{-5}$ mol/m$^2$.

The emulsion layers or other hydrophilic colloid layers of the light-sensitive materials of the present invention can contain water-soluble dyes as safelight dyes or anti-irradiation dyes or for other various purposes. Water-soluble dyes suitable as safe-light dyes are dyes for further reducing photographic sensitivity, and preferably ultraviolet absorbents having a spectral absorption maximum in an inherent sensitivity region of silver halide, and dyes for ensuring safety against safelight under which the bright room type photographic materials are processed, and preferably those showing substantial light absorption in the region of from 380 nm to 600 nm.

These dyes are preferably incorporated into the emulsion layers or layers above the silver halide emulsion layers, i.e., light-insensitive hydrophilic colloid layers farther from a support than the silver halide emulsion layers according to the end use and fixed therein with the aid of a mordant.

The amount of the ultraviolet absorbent to be added, though varying depending on molar extinction coefficient, usually ranges from $10^{-2}$ to 1 g/m$^2$, and preferably from 50 to 500 mg/m$^2$.

Incorporation of the ultraviolet absorbent in a coating composition can be carried out by dissolving it in an appropriate solvent, such as water, alcohols (e.g., methanol, ethanol, propanol, etc.), acetone, methyl cellosolve, etc., and mixtures thereof, and dispersing the solution in a coating composition.

The ultraviolet absorbent which can be used in the present invention includes aryl-substituted benzotriazole compounds, 4-thiazolidone compounds, benzophenone compounds, cinnamic ester compounds, butadiene compounds, benzoxazole compounds, and ultraviolet absorbing polymers. Specific examples of these ultraviolet absorbents are described in U.S. Pat. Nos. 3,533,794, 3,314,794 and 3,352,681, Japanese Patent Application (OPI) No. 2784/71, U.S. Pat. Nos. 3,705,805, 3,707,375, 4,045,229, 3,700,455 and 3,499,762, West German Patent Application (OLS) No. 1,547,863, etc.

Specific but non-limiting examples of the ultraviolet absorbents to be used in the present invention are shown below.

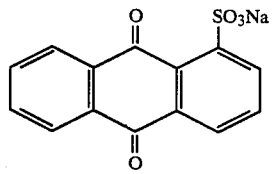
1

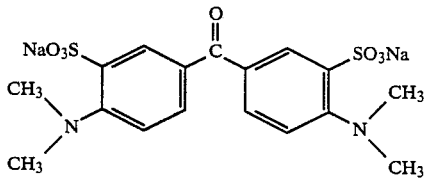
2

-continued
3
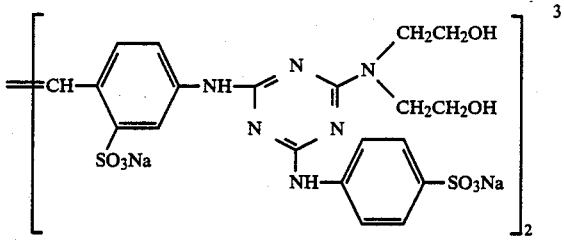
4
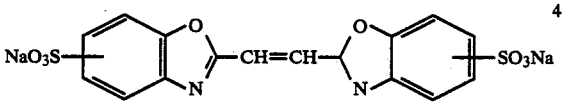
5
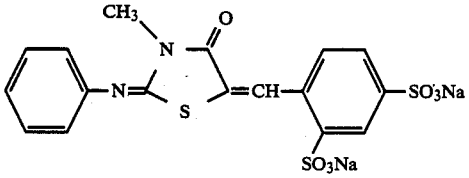
6
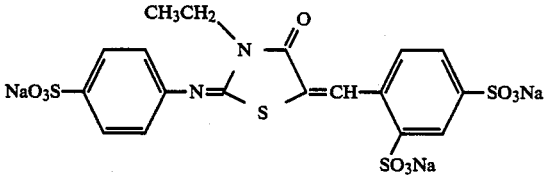
7
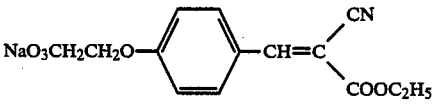
8
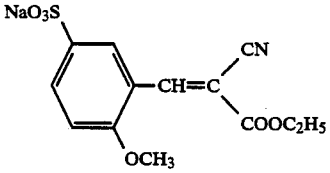
9
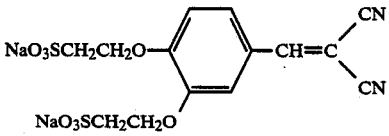
10
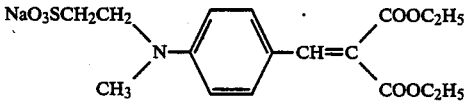
11
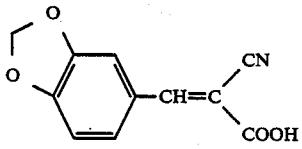
12
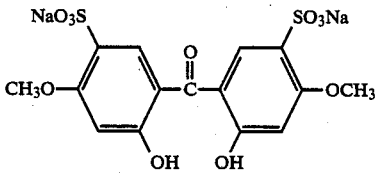
-continued
13
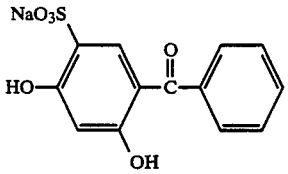
14
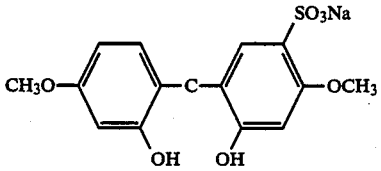
15
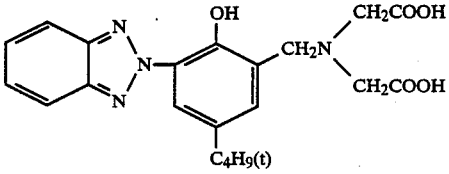
16
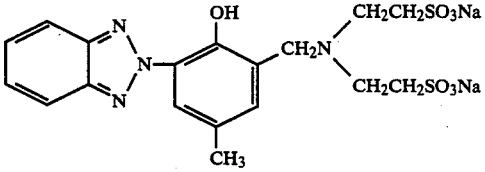
17
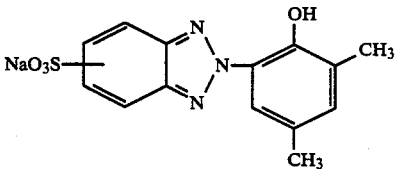
18
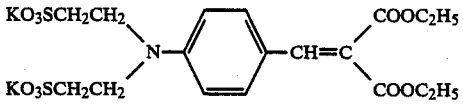
19
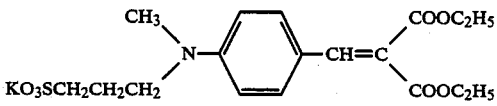
20
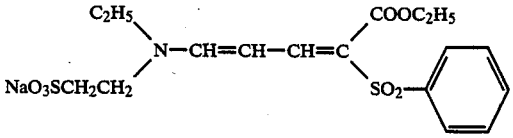
21
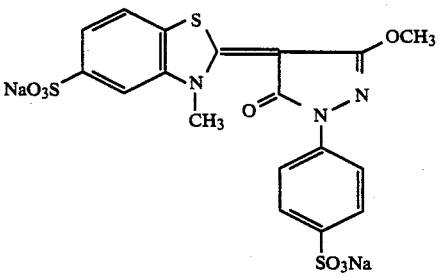

-continued

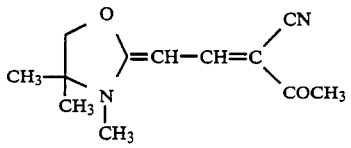

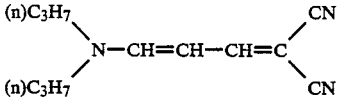

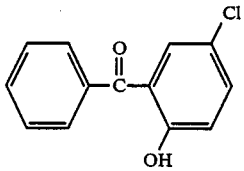

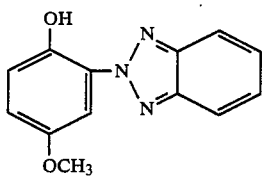

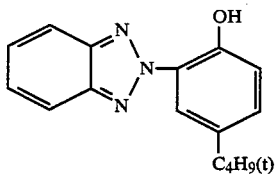

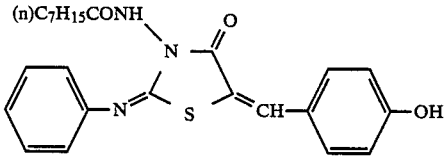

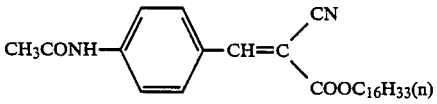

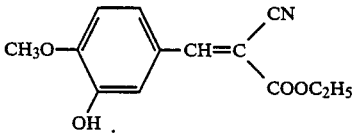

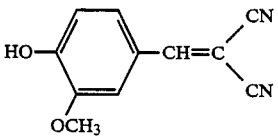

The safelight dyes which can be used in the present invention include oxonol dyes, hemioxonol dyes, styryl dyes, merocyanine dyes, cyanine dyes, and azo dyes. From the standpoint of minimizing color retention after development processing, water-soluble dyes or dyes decolorizable with an alkali or a sulfite ion are preferred. Examples of such filter dyes are the pyrazolone-oxonol dyes disclosed in U.S. Pat. No. 2,274,782; the diarylazo dyes disclosed in U.S. Pat. No. 2,956,879; the styryl dyes or butadienyl dyes disclosed in U.S. Pat. Nos. 3,423,207 and 3,384,487; the merocyanine dyes disclosed in U.S. Pat. No. 2,527,583; the merocyanine dyes or oxonol dyes disclosed in U.S. Pat. Nos. 3,486,897, 3,652,284 and 3,718,472; the enaminohemioxonol dyes disclosed in U.S. Pat. No. 3,976,661; and the dyes disclosed in British Patents 584,609 and 1,177,429, Japanese Patent Application (OPI) Nos. 85130/73, 99620/74 and 114420/74, U.S. Pat. Nos. 2,533,472, 3,148,187, 3,177,078, 3,247,127, 3,540,887, 3,575,704 and 3,653,095.

Specific examples of these filter dyes can be represented by the following formulae (V) to (X).

Formula (V) is represented by

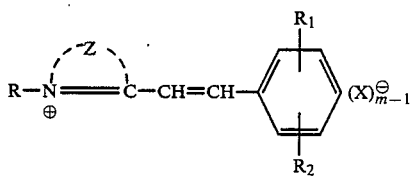

(V)

wherein Z represents a non-metal atomic group necessary for forming a benzothiazole ring, a naphthothiazole ring or a benzoxazole ring; R represents a substituted or unsubstituted alkyl group; $R_1$ and $R_2$, which may be the same or different, each represents a hydrogen atom, an alkoxy group, a dialkylamino group or a sulfo group; X represents an anion; and m represents 1 or 2.

In formula (V), when m is 1, the compound is in the form of an inner salt.

Substituents for the alkyl group which may be substituted of R include an alkoxy group (preferably having from 1 to 20 carbon atoms), an aryloxy group (preferably having from 6 to 10 carbon atoms), an alkoxycarbonyl group (preferably having from 2 to 20 carbon atoms), a carboxy group, a sulfo group, a halogen atom, a hydroxy group, an aryl group (preferably having from 6 to 10 carbon atoms), and a cyano group.

Specific examples of the anion of X are a halogen anion (e.g., chloride, bromide and iodide), a perchlorate, a tetrafluoroborate, a hexafluoro phosphate, a p-toluene sulfonate, a methane sulfonate, and an ethyl sulfonate.

Formula (VI) is represented by

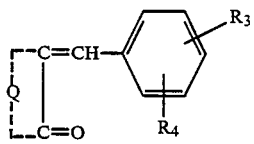

(VI)

wherein Q represents an atomic group necessary for forming a pyrazolone ring, a barbituric acid ring, a thiobarbituric acid ring, an isoxazolone ring, a 3-oxythionaphthene ring or a 1,3-indanedione ring; and $R_3$ and $R_4$, which may be the same or different, each represents a hydrogen atom, an alkoxy group, a dialkylamino group or a sulfo group.

Formula (VII) is represented by

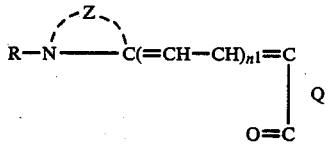

(VII)

wherein Z, Q and R are as defined above; and $n^1$ represents 1 or 2.

Formula (VIII) is represented by

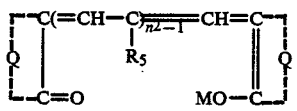

(VIII)

wherein Q is as defined above; $R_5$ represents a hydrogen atom or a halogen atom; M represents a hydrogen atom, a sodium atom or a potassium atom; and $n^2$ represents 1 or 2.

Formula (IX) is represented by

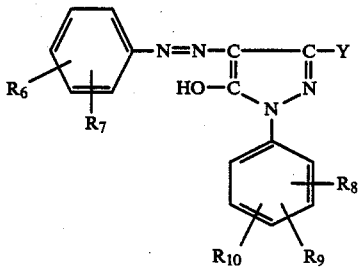

(IX)

wherein Y represents an alkyl group or a carboxyl group; and $R_6$, $R_7$, $R_8$, $R_9$ and $R_{10}$, which may be the same or different, each represents a hydrogen atom, an alkyl group, a hydroxyl group, an amino group, an acylamino group, a carboxyl group or a sulfo group.

Formula (X) is represented by

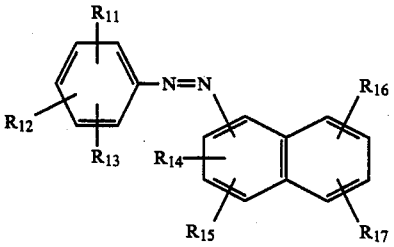

(X)

wherein $R_{11}$, $R_{12}$, $R_{13}$, $R_{14}$, $R_{15}$, $R_{16}$ and $R_{17}$, which may be the same or different, each represents a hydrogen atom, an alkyl group, a hydroxyl group, an amino group, an acylamino group, a carboxyl group or a sulfo group, or $R_{12}$ and $R_{13}$ are taken together to form a benzene ring.

Among the dyes represented by formulae (V) to (X), preferred are acid dyes having an acid radical, e.g., a sulfo group, a carboxyl group, etc., in the molecule. Specific examples of the acid dyes are shown below.

1.

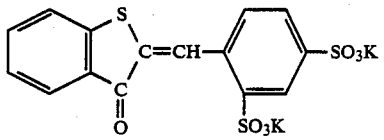

2.

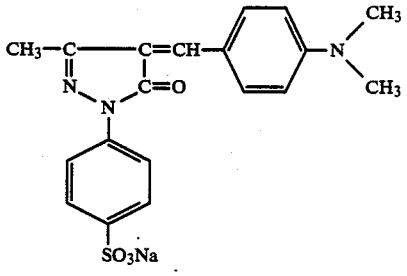

3.

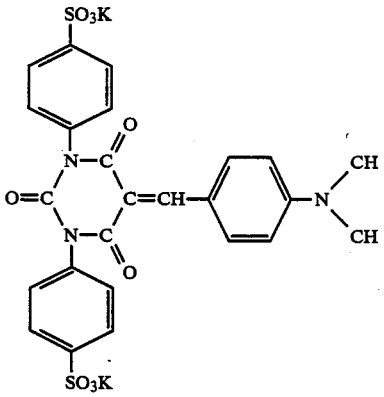

4.

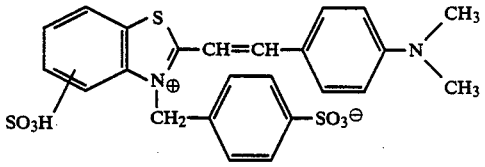

5.

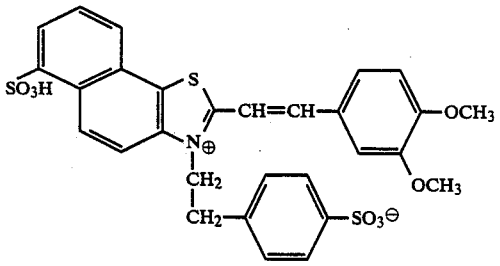

6.

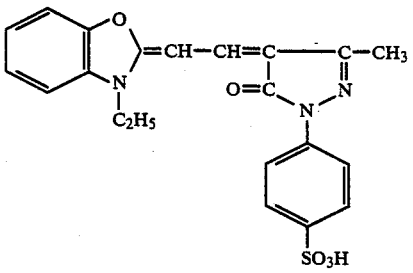

-continued
7.
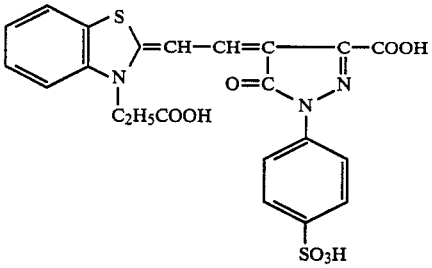
8.
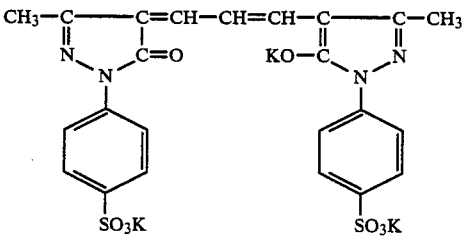
9.
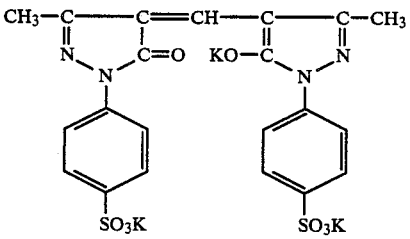
10.
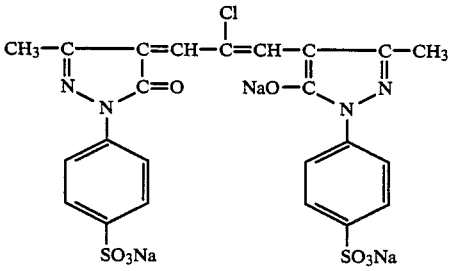
11.
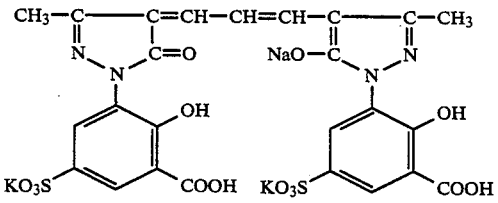
12.
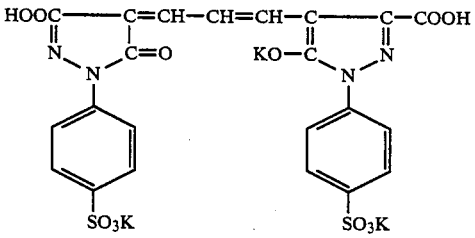
-continued
13.
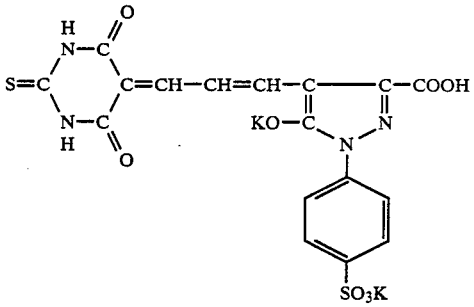
14.
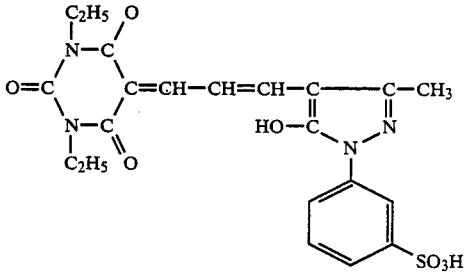
15.
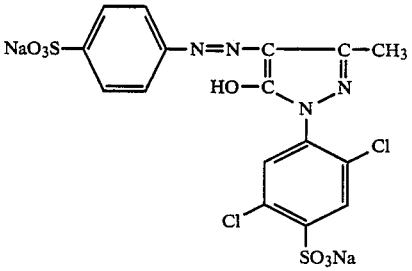
16.
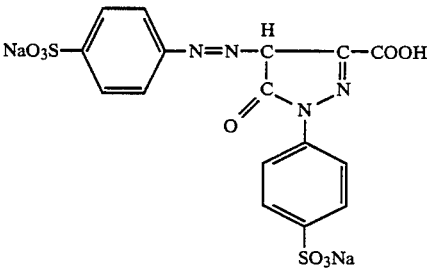
17.
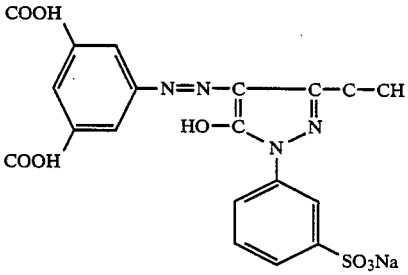
18.
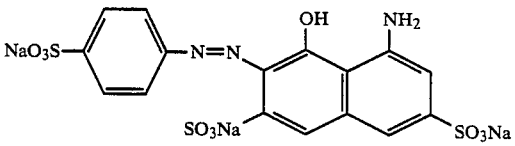

-continued

19.

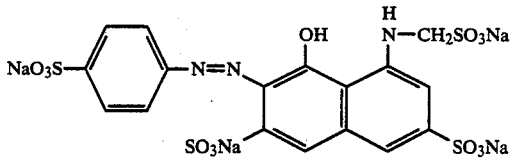

20.

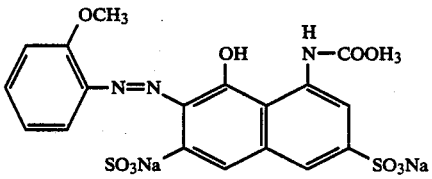

21.

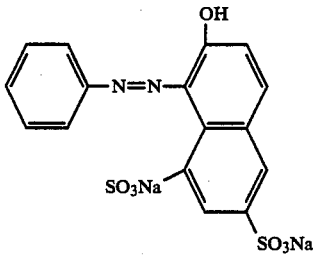

22.

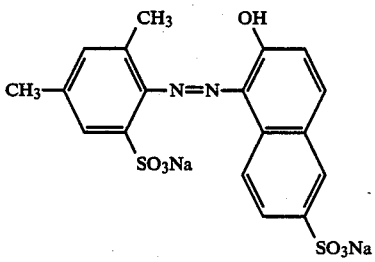

23.

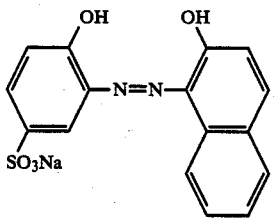

24.

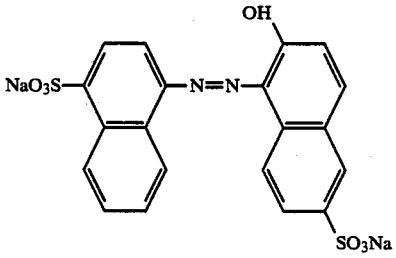

These dyes are incorporated into light-insensitive hydrophilic colloid layers by dissolving in an appropriate solvent, such as water, alcohols (e.g., methanol, ethanol, propanol, etc.), acetone, methyl cellosolve, etc., and mixtures thereof, and adding the solution to a coating composition. These dyes may be used either individually or in combinations of two or more thereof.

The aforesaid dyes are employed when the light-sensitive materials are intended to be handled in a bright room. Preferred amounts of these dyes are selected from the range of from $10^{-3}$ to 1 g/m$^2$, and particularly from $10^{-3}$ to 0.5 g/m$^2$.

Preferred binders or protective colloids for photographic emulsions include gelatin and, in addition, other hydrophilic colloids, such as proteins, e.g., gelatin derivatives, grafted polymers of gelatin and other high polymers, albumin, casein, etc.; cellulose derivatives, e.g., hydroxyethyl cellulose, carboxymethyl cellulose, cellulose sulfate, etc.; sugar derivatives, e.g., sodium alginate, starch derivatives, etc.; and a wide variety of synthetic hydrophilic high polymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc., or copolymers comprising monomers constituting these homopolymers.

Gelatin to be used includes not only lime-processed gelatin but acid-processed gelatin, hydrolysis products of gelatin, and enzymatic decomposition products of gelatin.

The silver halide emulsions to be used in the invention may or may not be subjected to chemical sensitization. Chemical sensitization can be carried out by any of sulfur sensitization, reduction sensitization, noble metal sensitization and combinations thereof.

Sulfur sensitization is effected by using sulfur compounds contained in gelatin and other various sulfur compounds, such as thiosulfates, thioureas, thiazoles, rhodanines, etc. Reduction sensitization is effected by using a reducing agent, such as stannous salts, amines, formamidinesulfinic acid, silane compounds, etc. Noble metal sensitization is typically carried out by gold sensitization using gold compounds, mostly gold complex salts. Complex salts of noble metals other than gold, e.g., platinum palladium, iridium, etc., may also be used. Specific examples of gold sensitization are described, e.g., in U.S. Pat. No. 2,448,060 and British Patent 618,061.

In general, use of spectral sensitizing dyes in bright room type light-sensitive materials have been avoided since the sensitizing dyes broaden the sensitive wavelength region to a longer side, only to deteriorate safety to safelight. Contrary to this commonly accepted knowledge, the inventors have found it favorable to weakly sensitize the light-sensitive materials according to the present invention in the region of from 450 nm to 600 nm. That is, in one embodiment of the present invention, the aforesaid spectral sensitization is effective to prevent fading of the latent image formed by imagewise exposure to light before development processing.

The sensitizing dyes which can be used to this effect are selected from compounds knonw to spectrally sensitize silver halide emulsions in the wavelength region of from 450 to 600 nm. Specific but non-limiting examples of such sensitizing dyes are shown below.

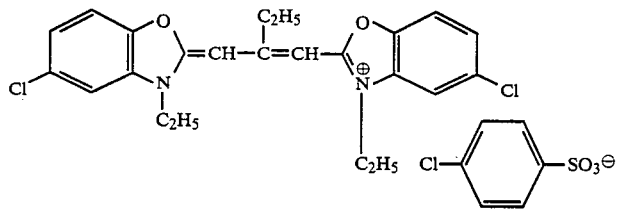

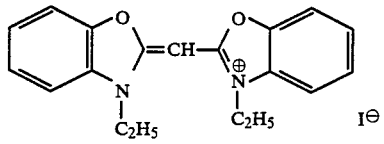

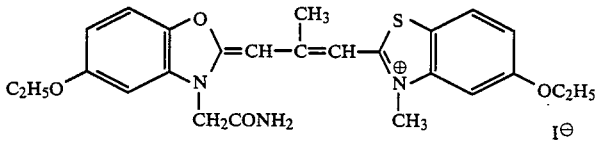

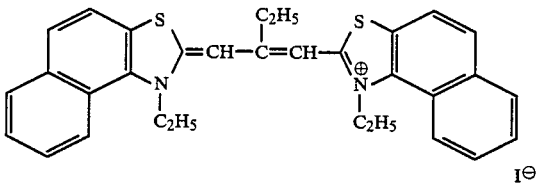

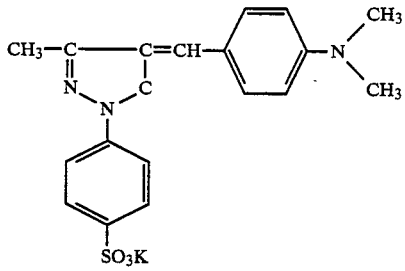

The light-sensitive materials according to the present invention can contain various compounds for the purpose of preventing fog during preparation, preservation or photographic processing of the light-sensitive materials or for stabilizing photographic performances. Such compounds include azoles, e.g., benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, benzotriazoles, etc.; mercaptopyrimidines; mercaptotriazines; thioketo compounds, e.g., oxazolinethione, etc.; azaindenes, e.g., triazaindenes, tetraazaindenes (particularly 4-hydroxy-substituted (1,3,3a,7)tetraazaindenes), pentaazaindenes, etc.; benzenethiosulfonic acid, benzenesulfinic acid, benzenesulfonic acid amide, and various other compounds known as antifoggants or stabilizers. Preferred among them are benzotriazoles (e.g., 5-methylbenzotriazole) and nitroindazoles (e.g., 5-nitroindazole). These compounds may be incorporated in a processing solution.

The photographic emulsion layers or any other hydrophilic colloid layers of the light-sensitive materials of the invention can further contain organic or inorganic hardening agents, such as chromium salts (e.g., chrome alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), epoxy compounds (e.g., tetramethylene glycol diglycidyl ether, etc.), isocyanate compounds (e.g., hexamethylene diisocyanate, etc.), and the like, either alone or in combinations thereof.

The photographic emulsion layers or other hydrophilic colloid layers can furthermore contain various surface active agents for various purposes, such as to aid in coating, static charge prevention, improvement of sliding properties, emulsification and dispersing, prevention of adhesion, improvement of photographic characteristics (e.g., development acceleration, increase in contrast, and increase in sensitivity), and the like. Examples of useful surface active agents include nonionic surface active agents, such as saponin (steroid type), alkylene oxide derivatives (e.g., polyethylene glycol, polyethylene glycol/polypropylene glycol condensates, polyethylene glycol alkyl ethers or alkylaryl ethers, polyethylene glycol esters, polyethylene glycol sorbitan esters, polyalkylene glycol alkylamines or alkylamides, polyethylene oxide adducts of silicone, etc.), glycidol derivatives (e.g., alkenylsuccinic acid polyglycerides, alkylphenol polyglycerides, etc.), fatty acid esters of polyhydric alcohols, alkyl esters of sugars, etc.; anionic surface active agents containing an acid group (e.g., a carboxyl group, a sulfo group, a phospho group, a sulfate group, a phosphate group, etc.), such as alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkyl phenyl ethers, polyoxyethylene alkylphosphates, etc.; amphoteric surface active agents, such as amino acids, aminoalkylsulfonic acids, aminoalkyl sulfates or phosphates, alkylbetaines, amine oxides, etc.; and cationic surface active agents, such as alkylamine salts, aliphatic or aromatic quaternary ammonium salts, heterocyclic quaternary ammonium salts, e.g., pyridinium, imidazolium, etc., aliphatic or heterocyclic phosphonium or sulfonium salts, and the like.

Surface active agents that are particularly preferred for use in the present invention are polyalkylene oxides having a molecular weight of 600 or more as described in Japanese Patent Publication No. 9412/83. Further, for the purpose of improving dimensional stability, polymer latices, such as polyalkyl acrylates, can be used.

Development accelerators or accelerators for nucleation infectious development suitable for use in the present invention include the compounds disclosed in Japanese Patent Application (OPI) Nos. 77616/78, 37732/79, 137133/78, 140340/85 and 14959/85, as well as various compounds containing a nitrogen atom or a sulfur atom. Specific examples of these accelerators are shown below.

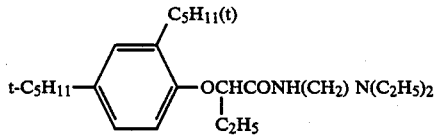

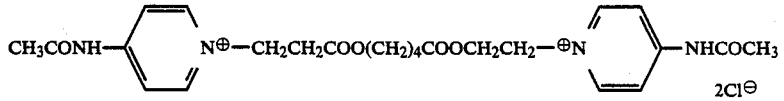

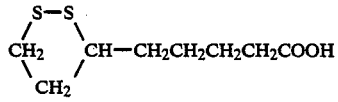

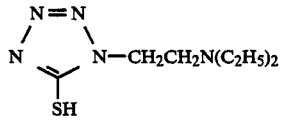

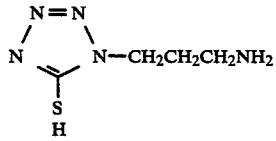

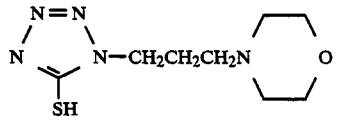

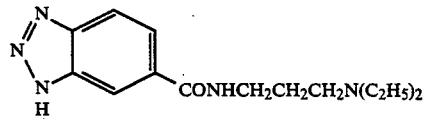

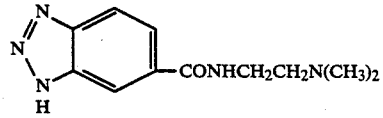

-continued

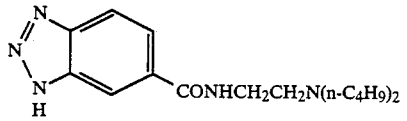

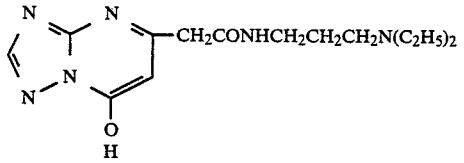

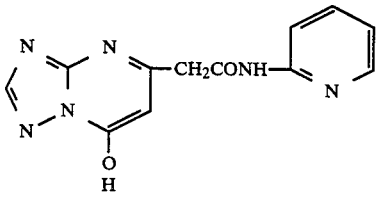

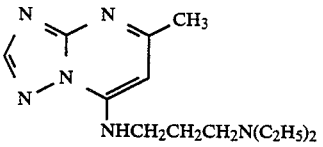

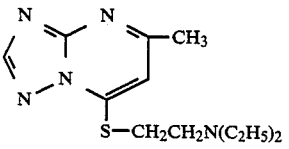

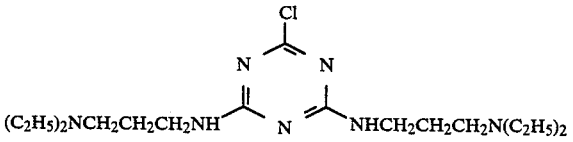

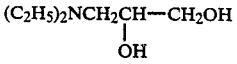

$n\text{-}C_4H_9N(C_2H_4OH)_2$

These accelerators are desirably used in an amount of from $1.0\times10^{-3}$ to 0.5 g/m$^2$, and preferably from $5.0\times10^{-3}$ to 0.1 g/m$^2$, though somewhat varying depending on the kind. These compounds are dissolved in an appropriate solvent, such as water, alcohols (e.g., methanol, ethanol, etc.), acetone, dimethylformamide, methyl cellosolve, etc., and the resulting solution is added to a coating composition. The above-described accelerators may be used either individually or in combinations thereof.

Photographic characteristics showing superhigh contrast can be attained by the silver halide light-sensitive materials according to the present invention through development with a stable developing solution without requiring any special developing solutions, such as conventional infectious developers and highly alkaline developers at a pH near 13 as described in U.S. Pat. No. 2,419,975.

That is, the silver halide light-sensitive materials of the present invention can be developed with a developing solution containing not less than 0.15 mol/liter of a sulfite ion as a preservative and having a pH value of from 10.5 to 12.3, and particularly from 11.0 to 12.0 to thereby obtain a negative image having a sufficiently superhigh contrast.

Developing agents which can be used in the developing solution are not particularly limited, and include dihydroxybenzenes (e.g., hydroquinone), 3-pyrazolidones (e.g., 1-phenyl-3-pyrazolidone, 4,4-dimethyl-1-phenyl-3-pyrazolidone), aminophenols (e.g., N-methyl-p-aminophenol), and mixtures thereof.

The silver halide light-sensitive materials of the present invention are particularly suitable for development processing with a developing solution containing dihydroxybenzenes as a main developing agent and 3-pyrazolidones or aminophenols as an auxiliary developing agent. Such a developing solution preferably contains from 0.05 to 0.5 mol/liter of the dihydroxybenzene and not more than 0.06 mol/liter of the 3-pyrazolidone or aminophenol.

The rate of development can be increased to realize reduction of development time by adding amines to a developing solution as described in U.S. Pat. No. 4,269,929.

The developing solution can further contain pH buffering agents, such as sulfites, carbonates, borates and phosphates of alkali metals; development restrainers or antifoggants, such as bromides, iodides and organic antifoggants (preferably nitroindazoles or benzotriazoles); and the like. If desired, the developing solution may furthermore contain hard water softeners, dissolution aids, color toning agents, development accelerators, surface active agents (preferalby the above-described polyalkylene oxides), defoaming agents, hardening agents, silver stain inhibitors (e.g., 2-mercaptobenzimidazole sulfonates), and the like.

In particular, useful silver stain inhibitors include those described in Japanese Patent Application (OPI) No. 24347/81; useful dissolution aids include those described in Japanese Patent Application (OPI) No. 267759/86; and useful pH buffering agents include those described in Japanese Patent Application (OPI) No. 93433/85 and Japanese Patent Application No. 28708/86.

A fixing solution to be used for fixation of the light-sensitive materials of the present invention has a commonly employed composition. Fixing agents to be used include thiosulfates, thiocyanates, and other organic sulfur compounds known to have fixing effects. The fixing solution may contain a water-soluble aluminum salt as a hardening agent.

The processing temperature is usually selected from a range of from 18° C. to 50° C.

Photographic processing is preferably carried out by means of an automatic developing machine. According to the present invention, even when the total processing time of from feed to an automatic developing machine to withdrawal therefrom is set at 90 to 120 seconds, a negative image having a sufficiently superhigh contrast can be obtained.

Examples of the support which can be used in the present invention are glass, cellulose acetate film, polyethylene terephthalate film, paper, baryta coated paper, polyolefin (e.g., polyethylene, polypropylene, etc.), laminate paper, polystyrene film, polycarbonate film, metal plate such as aluminum plate, or the like. These supports may be treated by corona discharge according to the known process, or if desired, may be undercoated by the known process.

The present invention will now be illustrated in greater detail by way of the following examples, but it should be understood that these examples are not deemed to limit the present invention. Unless otherwise indicated, all percents, parts and ratios are by weight.

COMPARATIVE EXAMPLE

A silver nitrate aqueous solution and a sodium chloride aqueous solution were added simultaneously to a gelatin aqueous solution kept at 40° C. in the presence of $5.0\times10^{-6}$ mol of $NH_4RhCl_6$ per mol of silver. After soluble salts were removed in a usual manner, gelatin was added to the system. To the non-sensitized (primitive emulsion thus prepared was added 2-methyl-4-hydroxy-1,3,3a,7-tetraazaindene as a stabilizer. The resulting emulsion was a monodispersed emulsion comprising cubic crystals having a mean gain size of 0.2 μm.

To the emulsion were added 74 mg/m$^2$ of a hydrazine compound (I-31). A polyethyl acrylate latex was added to the emulsion in an amount of 30% by weight (solid basis) based on gelatin, and 1,3-vinylsulfonyl-2-propanol was further added thereto as a hardening agent.

The resulting coating composition was coated on a polyester support to a silver coverage of 3.8 g/m$^2$ which corresponded to a gelatin coverage of 1.8 g/m$^2$. Gelatin was further coated thereon to a coverage of 1.5 g/m$^2$ to form a protective layer. The resulting sample was designated as Sample C-1-a.

Sample C-1-b was prepared in the same manner as C-1-a except that pinakryptol yellow was added as a desensitizer in the amount shown in Table 1 at the time the hydrazine compound was added. Sample C-1-c was prepared in the same manner as C-1-b except that phenosafranine was added in the amount shown in Table 1 in place of the pinakryptol yellow.

Each of the samples was exposed to light through an optical wedge using a daylight printer ("P-607" manufactured by Dainippon Screen Mfg. Co., Ltd.). Exposure of Sample C-1-a containing no organic desensitizer was conducted through an ND filter of 2.0 in density additionally overlaid on the optical wedge. The exposed samples were then developed at 38° C. for 30 seconds, fixed, washed, and dried.

The developer used had the following formulation.

| Developer Formulation | |
|---|---|
| Hydroquinone | 45.0 g |
| N—Methyl-p-aminophenol Hemisulfate | 0.8 g |
| Sodium Hydroxide | 18.0 g |
| Potassium Hydroxide | 55.0 g |
| 5-Sulfosalicylic Acid | 45.0 g |
| Boric Acid | 25.0 g |
| Potassium Sulfite | 110.0 g |
| Disodium Ethylenediaminetetraacetate | 1.0 g |
| Potassium Bromide | 6.0 g |
| 5-Methylbenzotriazole | 0.6 g |
| n-Butyldiethanolamine | 15.0 g |
| Water to make | 1 liter |
| | pH 11.6 |

Photographic properties of the resulting processed samples were determined, and the results obtained are shown in Table 1. In the Table, sensitivity (logE) is expressed in terms of difference from that of Sample C-1-a. For example, sensitivity of −1.0 means sensitivity lower by 1.0 in terms of logE, i.e., 10 times lower, than that of Sample C-1-a. Gradation (gamma) means a slope of a straight line connecting density points of 0.3 and 3.0 in a characteristic curve. The greater the gradation, the higher the contrast.

EXAMPLE 1

Samples 1-a to 1-i were prepared in the same manner as in the Comparative Example, except for replacing the known organic desensitizer with the compound according to the present invention as shown in Table 1. The samples were exposed to light and processed in the same manner as in the Comparative Example (Sample C-1-b). The photographic properties of the resulting prints are shown in Table 1.

It can be seen from the Table that any of the comparative samples containing conventional desensitizers exhibits decreased sensitivity and also low contrast, whereas the samples of Example 1 have not only low sensitivity but markedly high contrast.

TABLE 1

| Sample No. | Remarks | Desensitizer Kind | Desensitizer Amount (mg/m²) | Photographic Property Sensitivity | Photographic Property Gamma |
|---|---|---|---|---|---|
| C-1-a | Comparison | Blank | — | 0 | 19.0 |
| C-1-b | " | Pinakryptol Yellow | 24 | −1.1 | 2.5 |
| C-1-c | " | Phenosafranine | 30 | −0.9 | 2.0 |
| 1-a | Invention | Compound (II-1) | 8 | −0.9 | 11.0 |
| 1-b | " | Compound (II-2) | 15 | −1.2 | 14.0 |
| 1-c | " | Compound (II-4) | 8 | −1.0 | 13.0 |
| 1-d | " | Compound (II-8) | 14 | −1.2 | 15.0 |
| 1-e | " | Compound (II-9) | 9 | −1.1 | 13.0 |
| 1-f | " | Compound (II-18) | 25 | −1.0 | 11.5 |
| 1-g | " | Compound (II-19) | 21 | −0.8 | 10.0 |
| 1-h | " | Compound (II-26) | 30 | −0.7 | 10.0 |
| 1-i | " | Compound (II-7) | 11 | −1.3 | 11.0 |

EXAMPLE 2

Samples 2-a to 2-h were prepared in the same manner as in the Comparative Example, except for changing the hydrazine compound and the organic desensitizer as indicated in Table 2. The resulting samples were exposed to light and processed in the same manner as in the Comparative Example (Sample C-1-b), and photographic properties of processed samples are shown in Table 2.

It can be seen from Table 2 that the photographic materials containing hydrazines imparting high contrast and compounds having a water-soluble group among the organic desensitizers according to the present invention are particularly superior in forming a high contrast image.

TABLE 2

| Sample No. | Remarks | Hydrazine Compound Kind | Hydrazine Compound Amount (mg/m²) | Desensitizer Kind | Desensitizer Amount (mg/m²) | Photographic Property Sensitivity | Photographic Property Gamma |
|---|---|---|---|---|---|---|---|
| C-1-a | Comparison | (I-31) | 74 | Blank | — | 0 | 19.0 |
| C-1-b | " | " | 74 | Pinakryptol Yellow | 24 | −1.1 | 2.5 |
| C-1-c | " | " | 74 | Phenosafranine | 30 | −0.9 | 2.0 |
| 2-a | Invention | " | 74 | (II-8) | 14 | −1.2 | 15.0 |
| 2-b | " | (I-9) | 160 | " | 28 | −1.4 | 11.5 |
| 2-c | " | (I-32) | 28 | (II-9) | 9 | −0.8 | 13.0 |
| 2-d | " | (I-24) | 37 | (II-2) | 20 | −1.1 | 10.0 |
| 2-e | " | (I-18) | 30 | (II-8) | 14 | −1.5 | 9.0 |
| 2-f | " | (I-25) | 15 | " | 25 | −1.4 | 15.0 |
| 2-g | " | (I-31) | 74 | (II-37) | 7 | −1.2 | 7.0 |
| 2-h | " | " | 74 | (II-36) | 9 | −1.3 | 8.0 |

EXAMPLE 3

Sample 3-a was prepared in the same manner as in the Comparative Example, except for using a silver halide emulsion prepared as follows.

A monodispersed silver chloride emulsion was prepared in the same manner as in the Comparative Example. The emulsion was warmed at 50° C., and a sodium thiosulfate aqueous solution and a chloroauric acid aqueous solution were added thereto each in an amount of 4.5 mg (solid basis) per mol of silver, followed by stirring for 15 minutes to effect chemical sensitization.

To the resulting sensitized emulsion were added $18\times10^{-3}$ g/m² of a 9:1 (by weight) mixture of Nucleating Agent A and Nucleating Agent B shown below and $14\times10^{-3}$ g/m² of Organic Desensitizer (8).

Nucleating Agent A:

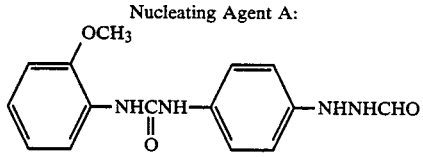

Nucleating Agent B:

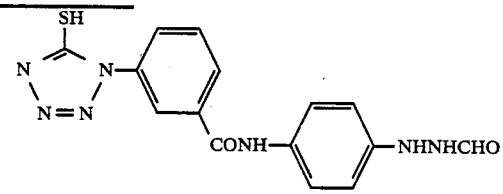

Further, 20 mg/m² of Nucleation Accelerator C, 55 mg/m² of Nucleation Accelerator D, 350 mg/m² of Ultraviolet Absorbent E, 30 mg/m² of Spectral Sensitizing Dye F, and 70 mg/m² of Safelight Dye G were added to the emulsion.

Nucleation Accelerator C:

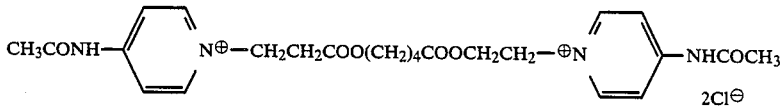

-continued

Nucleation Accelerator D:

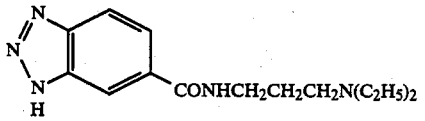

Ultraviolet Absorbent E:

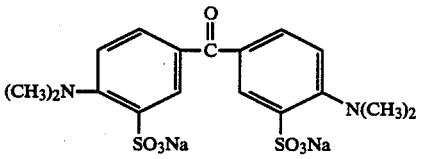

Spectral Sensitizing Dye F:

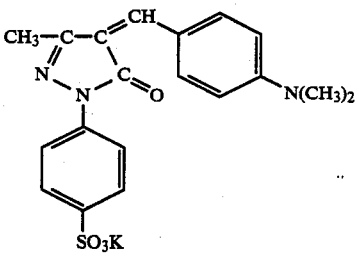

Safelight Dye G:

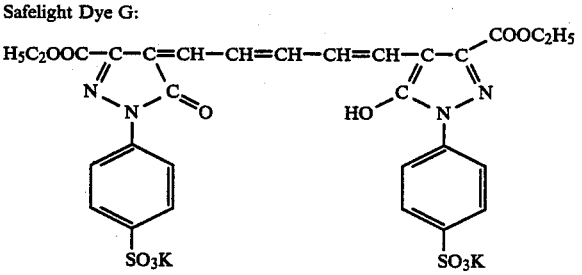

As a result, a sufficiently high contrast image was obtained through development at 38° C. for a period reduced to 20 seconds.

Sample 3-b was prepared in the same manner as for Sample 3-a, except for excluding the spectral sensitizing dye and the safelight dye.

In order to evaluate safety to safelight, each of Samples 3-a and 3-b was imagewise exposed to light and then exposed to light emitted from a UV cut fluorescent lamp (safelight) ("FLR-40SWDLX-NU/M" manufactured by Toshiba Corporation) at an illuminance of 400 lux for 5, 30 or 60 minutes, followed by development processing in the same manner as in the Comparative Example. The photographic sensitivity was measured, and the difference (ΔlogE) from that of the corresponding sample which was not exposed to safelight is shown in Table 3 below.

TABLE 3

| Safelight Exposure Time | ΔlogE | |
|---|---|---|
| | Sample 3-a | Sample 3-b |
| 5 minutes | 0.10 | 0.15 |
| 30 minutes | 0.10 | 0.4 |
| 60 minutes | 0.10 | 0.75 |

As is apparent from Table 3, Sample 3-b has a decreasing sensitivity as the safelight exposure time becomes longer. Under the particular safelight conditions, safety of Sample 3-b to safelight cannot be expected unless the exposure time is less than about 5 minutes. In distinction, Sample 3-a is safe even against 60 minutes' exposure.

When Samples C-1-b and C-1-c as prepared in the Comparative Example were evaluated for safety to safelight exposure in the same manner as described above, the reduction in sensitivity (ΔlogE) after 30 minutes' exposure was 0.6 in both cases.

Then, changes of photographic properties due to environmental humidity during imagewise exposure were examined. As a result, it was surprisingly discovered that Samples C-1-b, C-1-c, and 3-b underwent great reduction of photographic sensitivity as showing ΔlogE of about 0.6 when relative humidity rose from 30% to 80%, whereas that of Sample 3-a was only 0.1 under the same condition.

While the invention has been described in detail and with reference to specific embodiments thereof, it will be apparent to one skilled in the art that various changes and modifications can be made therein without departing from the spirit and scope thereof.

What is claimed is:

1. A superhigh contrast negative type silver halide photographic material comprising a support having provided thereon at least one silver halide emulsion layer, wherein said emulsion layer or at least one other hydrophilic colloid layer contains at least one hydrazine derivative and at least one organic desensitizer having at least one water-soluble group or alkali-dissociative group.

2. A superhigh contrast negative type silver halide photographic material as claimed in claim 1, wherein said hydrazine derivative has the following structure:

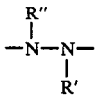

wherein R′ can be either hydrogen or a sulfinic acid radical substituent, and R″ is chosen to be a sulfinic acid radical substituent when R′ is hydrogen and hydrogen when R′ is a sulfinic acid radical.

3. A superhigh contrast negative type silver halide photographic material as claimed in claim 1, wherein said hydrazine derivative is represented by formula (I)

$$R_1\text{—NHNH—CHO} \qquad \text{(I)}$$

where $R_1$ represents an aliphatic group or an aromatic group.

4. A superhigh contrast negative type silver halide photographic material as claimed in claim 1, wherein said hydrazine derivative is present in an amount of from $10^{-6}$ to $1\times10^{-1}$ mol per mol of total silver halide.

5. A superhigh contrast negative type silver halide photographic material as claimed in claim 1, wherein said organic desensitizer is selected from compounds represented by formula (II)

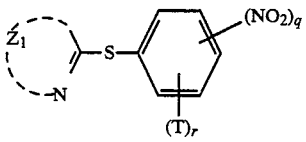

(II)

wherein $Z_1$ represents a non-metal atomic group necessary for forming a substituted or unsubstituted nitrogen-containing heterocyclic group; T represents a substituted or unsubstituted alkyl group, a substituted or unsubstituted cycloalkyl group, a substituted or unsubstituted alkenyl group, a halogen atom, a cyano group, a trifluoromethyl group, a substituted or unsubstituted alkoxy group, a substituted or unsubstituted aryloxy group, a hydroxyl group, a substituted or unsubstituted alkoxycarbonyl group, a carboxyl group, a substituted or unsubstituted carbamoyl group, a substituted or unsubstituted sulfamoyl group, a substituted or unsubstituted aryl group, an acylamino group, a substituted or unsubstituted sulfonamido group, a sulfo group or a substituted or unsubstituted benzene condensed ring; $Z_1$ and T each contains at least one water-soluble group or alkali-dissociative group; q represents 1, 2 or 3; and r represents 0, 1 or 2; compounds represented by formula (III)

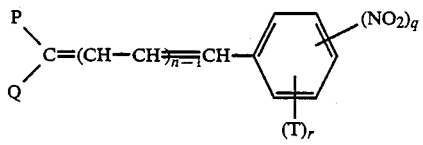

(III)

wherein T, r and q are as defined above; P and Q, which may be the same or different, each represents a cyano group, an acyl group, a thioacyl group, an alkoxycarbonyl group, an alkylsulfonyl group, an arylsulfonyl group, a substituted or unsubstituted sulfamoyl group, a substituted or unsubstituted carbamoyl group, a nitro group or a substituted or unsubstituted aryl group; T, P and Q each contains at least one water-soluble group or alkali-dissociative group; and n represents 1, 2 or 3; and compounds represented by formula (IV)

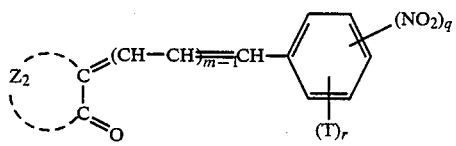

(IV)

wherein T, r and q are as defined above; $Z_2$ represents a non-metal atomic group necessary for forming a keto-methylene ring; $Z_2$ and T each contains at least one water-soluble group or alkali-dissociative group; and m represents 1, 2 or 3.

6. A superhigh contrast negative type silver halide photographic material as claimed in claim 1, wherein said organic desensitizer is present in an amount of from $1.0\times10^{-8}$ to $1.0\times10^{-4}$ mol/m$^2$.

7. A superhigh contrast negative type silver halide photographic material as claimed in claim 1, wherein a silver halide emulsion layer contains a water-soluble rhodium salt in an amount of from $10^{-8}$ to $10^{-4}$ mol per mol of silver halide.

* * * * *